US005375377A

United States Patent [19]

Kenton

[11] Patent Number: 5,375,377

[45] Date of Patent: Dec. 27, 1994

[54] INTERNAL TRAY FOR A VIBRATORY MILL

[75] Inventor: Anthony F. Kenton, Hatboro, Pa.

[73] Assignee: Nova Finishing Systems, Inc., Hatboro, Pa.

[21] Appl. No.: 922,281

[22] Filed: Jul. 29, 1992

Related U.S. Application Data

[63] Continuation-in-part of Ser. No. 488,869, Mar. 5, 1990, abandoned.

[51] Int. Cl.[5] ..... B24B 31/00

[52] U.S. Cl. ..... 451/32; 451/326

[58] Field of Search ..... 51/163.1, 163.2, 164.1, 51/164.2; 134/118, 121, 133, 134

[56] References Cited

U.S. PATENT DOCUMENTS

| | | | |
|---|---|---|---|
| 3,134,203 | 5/1964 | Roberts | 51/164.1 |
| 3,315,417 | 4/1967 | Roberts | 51/163.1 |
| 3,405,483 | 10/1968 | Boniface | 51/163.1 |
| 3,435,565 | 4/1969 | Blundell | 51/163.1 |
| 3,680,266 | 8/1972 | Shiplov | 51/163.1 |
| 3,693,298 | 9/1972 | Ferrara | 51/163.2 |
| 3,774,888 | 11/1973 | Isaacson | 51/163.1 |
| 4,034,520 | 7/1977 | Balz | 51/163.1 |
| 4,067,147 | 1/1978 | Leliaert | 51/163.2 |
| 4,081,929 | 4/1978 | Jones et al. | 51/163.2 |
| 4,115,960 | 9/1978 | Zecher | 51/163.1 |
| 4,566,144 | 1/1986 | Arneson | 51/164.1 |

*Primary Examiner*—M. Rachuba

*Attorney, Agent, or Firm*—Synnestvedt & Lechner

[57] ABSTRACT

A vibratory mill includes a retractable separator basket for removing work parts from the work media after processing of parts has been completed. The basket is concentric with the work chamber bowl and is fitted around and supported by the upturn center portion of the bottom of the bowl. The separator basket comprises a circular frame and a replaceable screen of desired mesh size. This screen is in the shape of a flat ring placed on the frame to form a separating bed of substantially horizontal orientation when in use. The bed of the separator is positioned below the turnpoint of the material flow inside the work chamber.

6 Claims, 4 Drawing Sheets

INTERNAL TRAY FOR A VIBRATORY MILL

RELATED APPLICATIONS AND CLAIM OF PRIORITY

This application is a continuation-in-part of co-pending U.S. Ser. No. 07/488,869 filed Mar. 5, 1990 entitled "Internal Tray for a Vibratory Mill", now abandoned which is incorporated herein by reference as if set forth in full.

FIELD OF THE INVENTION

This invention relates to bowl-type vibratory polishing and de-burring mills. It particular, the present invention is specifically related to means for separating the treated parts from the work media after the milling process is completed.

BACKGROUND OF THE INVENTION AND PRIOR ART

Bowl-type fixed vibratory polishing mills are well-known and widely used by hobbyists and machine shops. These machines are commonly known as "tumblers" and are used to polish gems, to de-burr small machine parts, and for other similar operations. Typically, in operation, parts are placed inside of the work chamber or bowl of the tumbler, which is also filled with a solid abrasive work media, such as ceramics, plastics, sand or steel shot. The vibrating action of the bowl circulates the parts through the work media to achieve the desired abrading or polishing.

To achieve the proper circulating action of the work media and parts, the sides of the work chamber are typically bowl-shaped and inwardly turned at the top. The bottom of the bowl may have a peak rising from the center. Typically, the bowl is rigidly affixed to an oscillating platform so that efficient oscillation can be transmitted to the bowl.

However, these conditions present a problem after the treatment process is completed, and the parts and media are to be removed from the bowl and separated. Most commonly, this is achieved by simply turning the machine upside down and dumping out the parts and work media, and picking the parts from the work media by hand. Before treating another group of parts, the work media is then reintroduced to the work chamber and the new parts to be treated are added.

The use of a vibratory mill thus requires substantial dumping and replacement of the work media which is often a messy and time-consuming effort. It is an object of the present invention to provide a fixed vibratory, bowl-type mill with means for conveniently separating parts from the work media after the treatment process has been completed. It is a further object of the present invention to provide a vibratory mill with means to remove treated parts from within the work chamber bowl without removing the work media. Other objects, advantages and uses of the present device will be readily apparent to those of ordinary skill in the art, given the following drawings and further description.

There have been several prior art patents directed to vibratory mills. U.S. Pat. No. 3,435,565 discloses a device for the surface treatment of work pieces. The work pieces are extracted after they have been treated by lowering a sieving basket into the circulating mask. The flow of the mask containing the work results in both the mask and the work being deposited in the basket. The basket can then be raised and the parts removed.

The system specifically includes a vertically rotating shaft to accomplish media removal. The vertical rotating shaft is secured at its bottom to a dished bowl which closes the lower end of the stationary vertical tub mounted on a base. The shaft extends upwardly and has a square shaft on its outside which can be clutched and declutched to the inner shaft as desired, in order to rotate the square shaft.

The perforated basket is secured to the lower end of the sleeve to receive the circulating mask and the work pieces. To remove the work pieces, the basket is connected by the clutch to rotate with the bottom of the bowl, and the cylinder is operated to lower the basket into or near the bowl. The basket is then mechanically lifted while rotating to discharge the mask and retain the work.

U.S. Pat. No. 3,774,888 to Isaacson discloses a system in which electromagnets are used to vibrate a container holding a mass and work pieces in an off-centered manner, so as to establish an orbital or circular flow up one side, across the top, and down the other side of the container. The device includes a scoop which may comprise either a curved or mesh or a tray-like mesh which includes levers which enable one to move the screen down into the orbital path and intercept the mass and work pieces, and to then lift the mesh upward where it can be shaken to return the mass to the container.

SUMMARY OF THE INVENTION

In order to achieve the objectives of the present invention, a retractable separator basket for use in a vibratory mill has been devised. The basket is concentric with the work chamber bowl and is fitted around and supported by the upturned center portion of the bottom of the bowl. Alignment of the basket is aided by an extension of the frame of the basket which is aligned by the center post of the mill. The separator comprises a circular frame and a replaceable screen of desired mesh size. The screen is in the shape of a flat ring placed on the frame to form a separating bed of substantially horizontal orientation when in use. The bed of the separator is initially placed on the media and positioned below the turnpoint of the material flow inside the work chamber.

In operation, the milling process begins and proceeds as normal. When the treatment of the parts has been completed, the separator basket is placed on the media and lowered by the vibrational and toroidal action of the mill into the bowl to asecond and final resting position. The parts follow the direction of flow within the work chamber bowl, move up the sides of the bowl and pass down over the basket from above. A properly selected screen size will permit the work media to easily flow through the basket while retaining the treated parts. After sufficient time following the point when the separator basket sinks into the bowl to the final resting position, the separator basket can be lifted from inside the work bowl thereby removing taking away the treated parts with it. A more complete understanding of the present invention will be supplied by the following drawings and description of the preferred embodiment.

BRIEF DESCRIPTIONS OF THE DRAWINGS

Figure 5A:
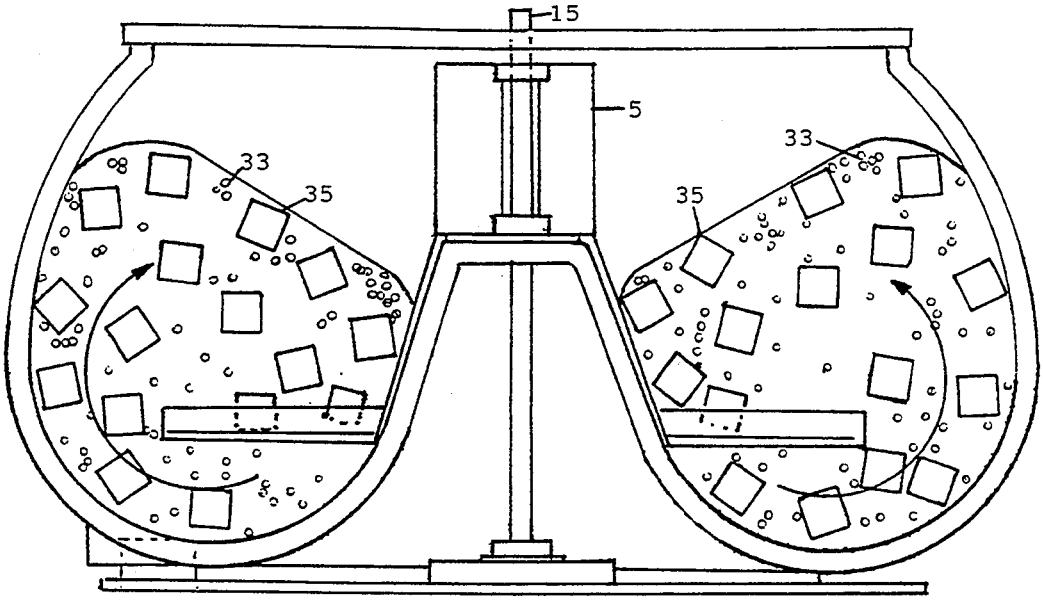
Figure 5B:
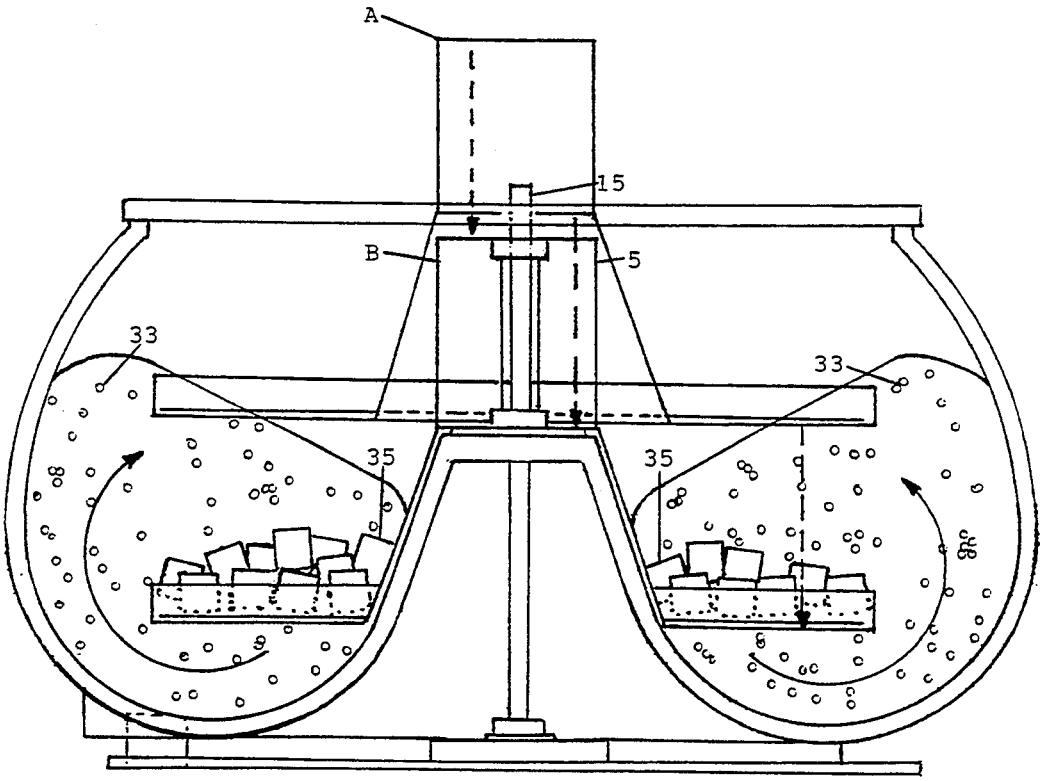

FIGS. 5*a* and 5*b* are diagrams showing steps in the process of separating parts from the work media.

DESCRIPTION OF THE PREFERRED EMBODIMENT

Figure 1:
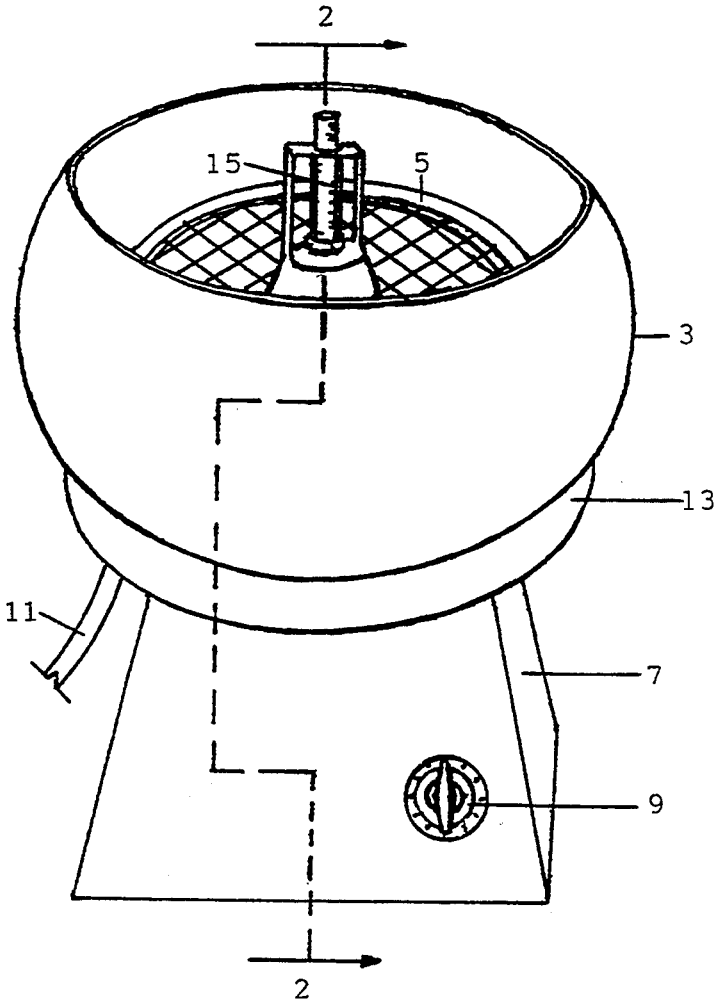
FIG. 1 is a top right front perspective view of the present device.

Referring to FIG. 1, an external view of the present device is shown. Base 7 supports vibrator plate 13 to which the work chamber bowl 3 is attached by way of center post 15. Fastener 1 secures transparent lid 17 across the top of the bowl. Separator basket 5 is centrally located within the work chamber bowl. Operation of the mill is limited by timer 9. Drain line 11 is connected to an outlet port at the bottom of the work chamber bowl for convenient removal of liquids.

Figure 2:
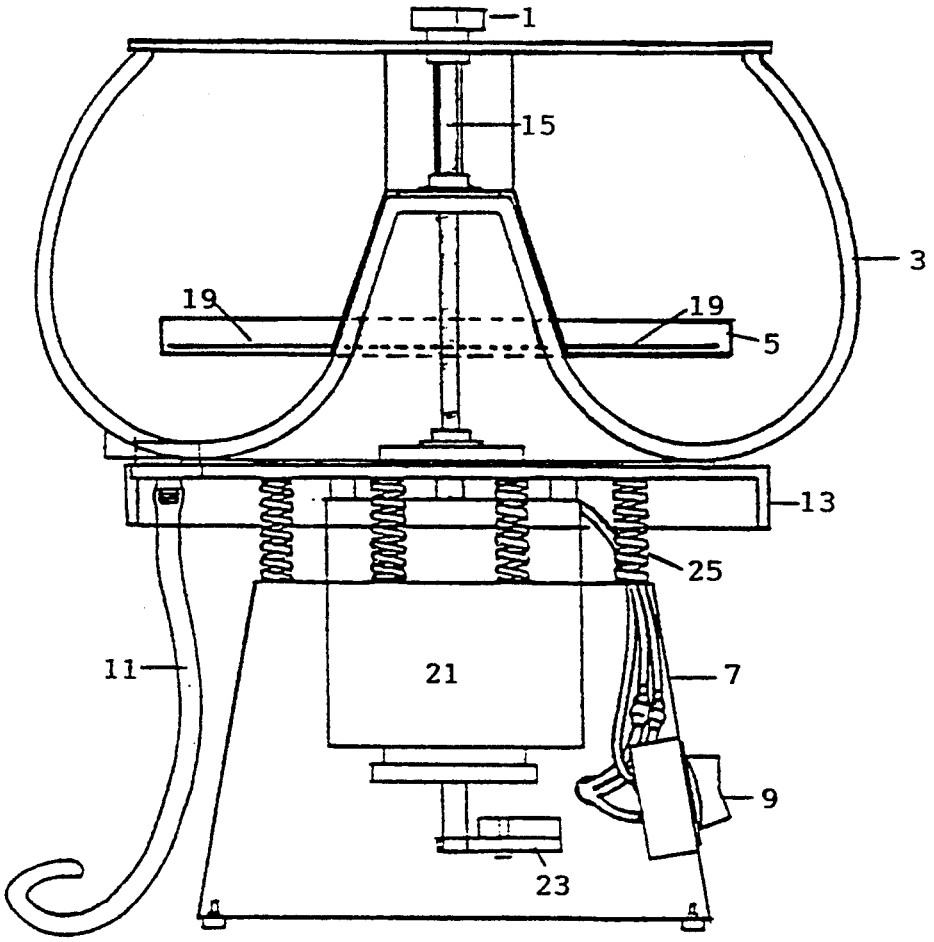
FIG. 2 is a sectional and cut-away view taken from FIG. 1 as shown in that figure.

Referring now to FIG. 2, separator basket 5 is located within the work chamber bowl and is substantially horizontal when in operation. Lid 17 is fastened to the top of the bowl by fastener 1 which secures both the frame of the basket 5 and the lid to the center post 15. Screen 19 sits across the bottom of the basket frame 5 and is held in position only be the force of gravity making it easily replaceable for changing the mesh size. The other components of the vibratory mill are standard components which include vibrator plate 13 which is spring-mounted to base 7 by resilient means 25. Motor means 21 is rigidly affixed to the vibrator plate and is moved by way of eccentric mechanism 23 which is secured to the base 7.

Figure 3:
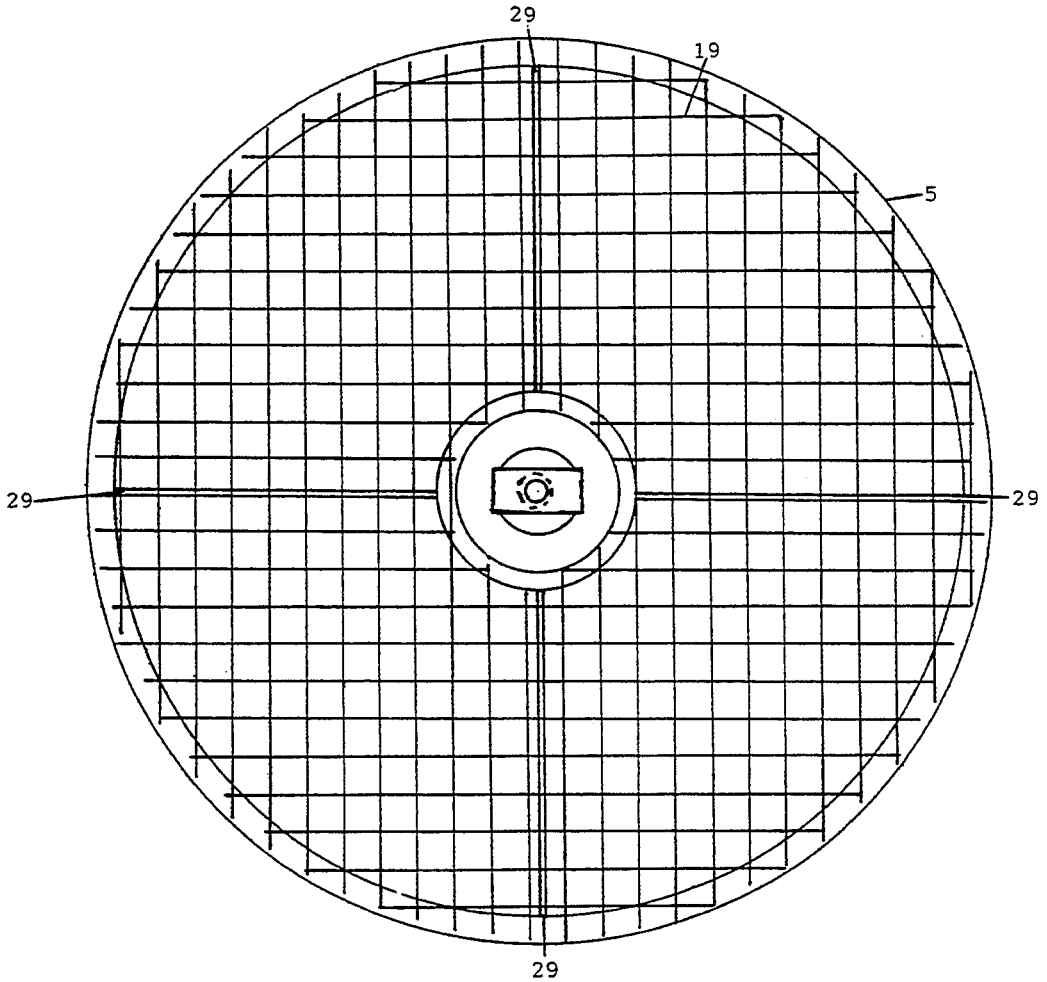
FIG. 3 is a top plan view of the separator basket.
Figure 4:
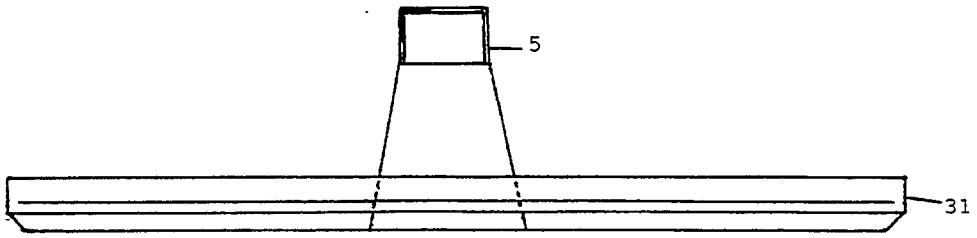
FIG. 4 is a side view of the separator basket.

Referring now to FIGS. 3 and 4, basket frame 5 holds annular screening 19 which is supported by frame pieces 29. As shown in FIG. 4, the basket includes a vertical perimeter rim 31 which laterally retains objects captured by the basket.

Referring now to FIGS. 5*a* and 5*b*, after the milling process has been completed, the lid is removed from the top of the work chamber bowl and the separator basket 5 is placed on top of the work media 33 and about center post 15 as shown at "a". This position represents an initial starting point for the process. Treated parts 35 as shown in FIG. 5*a* are evenly distributed in the work chamber bowl throughout the work media. The mill is now re-activated without the lid or fastener. The basket frame 5 is quickly pulled downward along center post 15 and held downwardly by the flow of the work media as shown in FIG. 5*b* at a second resting position "b". The second or final resting position "c" is at a point just below the center point of media rotation.

As shown in FIG. 5*b*, after a short time, the rotating action of the work media causes both media and work parts 35 to circulate from below to above the separator basket which is held below the turnpoint of material a fixed distance from the lowest point of the bottom of the bowl. Work media 33 easily passes through the screening in the bottom of the basket while retaining parts 35. After a short time approximately 2–3 minutes, all of the parts are retained by the basket and may be conveniently removed from the work chamber bowl by manually lifting out the basket.

The operation described above permits the convenient separation of parts from work media without requiring removal of the work media from the bowl. It will be readily apparent to those of ordinary skill in the art that the above-described separator basket, which operates as an internal trap within the circulating medium in the work bowl, may be suitable for use as an accessory for other than separation of parts from work media. For example, the above-described separator basket may be used as a part holder for a washing operation where the work media is a liquid which circulates through the basket due to the vibratory action of the bowl.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A vibratory mill, comprising:

a. a work chamber bowl connected to vibrator means for imparting an oscillating motion to the bowl; and b. a parts separator basket resting on particulate media within the said bowl and being held in a substantially horizontal orientation by vertical support post means at a first vertical position within the bowl by being placed on said media the oscillating motion of the media pulling the basket downwardly into said bowl as the media is vibrated such that the parts separator basket terminates at a second vertical position.

2. The vibratory mill of claim 1 wherein said basket is circular and concentric with said bowl and further includes a replaceable screen.

3. The vibratory mill of claim 2 wherein said basket includes a peripheral vertical rim for retaining objects trapped in said basket.

4. The vibratory mill of claim 3 further including a mixture of work media and work parts within said bowl, said work media including only solid articles, and said parts being substantially larger than said work media.

5. The vibratory mill of claim 4 wherein the motion and shape of the work chamber bowl causes circulation of the work media and work parts from the bottom of the bowl to higher levels within the media/parts mixture, whereby work parts are moved from below said separator basket into said basket.

6. The vibratory mill of claim 5 wherein said screen has a mesh size greater than the particle size of said work media, yet is smaller than the size of said treatment parts such that the screen permits the passage of said work media while retaining said parts.

* * * * *